US007118179B1

(12) United States Patent
Wilson et al.

(10) Patent No.: US 7,118,179 B1
(45) Date of Patent: Oct. 10, 2006

(54) PORTABLE WALL MOUNTED HEADBOARD

(76) Inventors: Stephanie W. Wilson, 406 Calloway Ct., Silver Spring, MD (US) 20905; Colleen E. Tompson, 13833 Castle Cliff Way, Silver Spring, MD (US) 20904

( * ) Notice: Subject to any disclaimer, the term of this patent is extended or adjusted under 35 U.S.C. 154(b) by 37 days.

(21) Appl. No.: 10/942,952

(22) Filed: Sep. 17, 2004

(51) Int. Cl.
*A47C 7/36* (2006.01)
*A47C 17/00* (2006.01)

(52) U.S. Cl. ..... 297/395; 297/DIG. 6; 5/53.1

(58) Field of Classification Search ..... 297/395, 297/DIG. 6, 397; 5/53.1
See application file for complete search history.

(56) References Cited

U.S. PATENT DOCUMENTS 2,679,998 A * 6/1954 Keller ..... 248/205.3
4,919,483 A * 4/1990 Horkey ..... 297/395
5,028,472 A * 7/1991 Gray ..... 428/100
5,269,032 A 12/1993 Flocks
6,182,307 B1 * 2/2001 Rutrick ..... 5/53.1
6,371,190 B1 4/2002 Owens
6,374,440 B1 4/2002 Thim, Jr.
6,467,099 B1 * 10/2002 Dennis et al. ..... 2/455
6,618,876 B1 9/2003 Murphy et al.
2003/0135928 A1 7/2003 Murphy et al.

* cited by examiner

*Primary Examiner*—Milton Nelson, Jr.
(74) *Attorney, Agent, or Firm*—Blank Rome LLP

(57) ABSTRACT

A headboard that includes a cushioning member and a flexible cover substantially enclosing the cushioning member. The flexible cover includes at least first and second opposite panels. The first panel is formed of a fabric that has a plurality of loops. A support includes a fastener disposed thereon. The fastener is formed of a plurality of hooks that engage the plurality of loops of the first panel, thereby releasably engaging the first panel with the support.

10 Claims, 1 Drawing Sheet

PORTABLE WALL MOUNTED HEADBOARD

FIELD OF THE INVENTION

The present invention relates to a wall mounted headboard for a bed that is lightweight and portable. More specifically, the headboard of the present invention is releasably mounted to the wall by a hook and loop attachment.

BACKGROUND OF THE INVENTION

Conventional headboards for beds are often bulky and heavy making them difficult to move. Additionally, many conventional headboards are attached directly to the frame of the bed, thereby requiring assembly to the frame to use the headboard and disassembly before moving the headboard. Furthermore, conventional headboards can often only be purchased with the bed frame and not purchased separately.

Examples of headboards are disclosed in U.S. Pat. No. 6,618,876 to Murphy et al.; 6,374,440 to Thim, Jr.; 6,371,190 to Owens; 6,182,307 to Rutrick; and 5,269,032 to Flocks; and U.S. Patent Application Publication No. 2003/0135928, the subject matter of each of which is herein incorporated by reference.

SUMMARY OF THE INVENTION

Accordingly, an object of the present invention is to provide a headboard that is lightweight and portable.

Another object of the present invention is to provide a headboard that releasably mounts to a support, such as a wall.

Yet another object of the present invention is to provide a headboard that is inexpensive to make and is decorative.

The foregoing objects are basically attained by a headboard that includes a cushioning member and a flexible cover substantially enclosing the cushioning member. The flexible cover includes at least first and second opposite panels. The first panel is formed of a fabric that has a plurality of loops. A support includes a fastener disposed thereon. The fastener is formed of a plurality of hooks that engage the plurality of loops of the first panel, thereby releasably engaging the first panel with the support.

The foregoing objects are also attained by a headboard that includes a foam cushioning member and a fabric cover enclosing the foam cushioning member. The fabric cover includes at least rear and front opposite panels. The rear panel consists of a fabric having a plurality of loops, and the front panel includes decorative indicia. A support includes a fastener fixed thereto. The fastener is formed of a plurality of hooks engaging the plurality of loops of the rear panel, thereby releasably engaging the rear panel with the support.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 2:
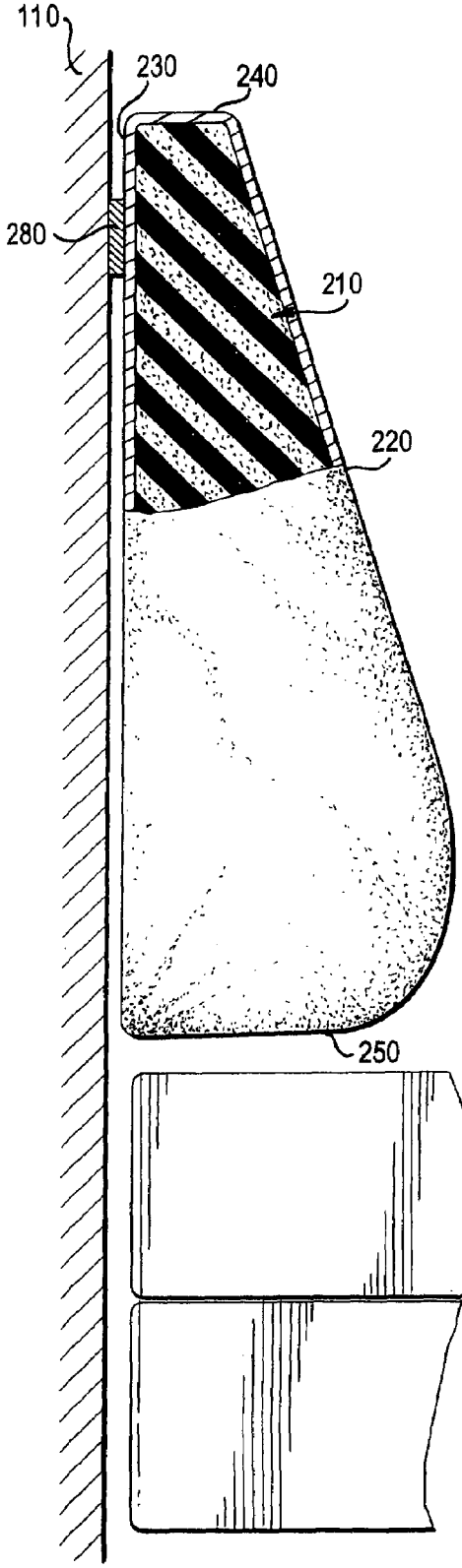
FIG. 2 is an enlarged side elevational view of the headboard illustrated in FIG. 1, showing a hook and loop releasable attachment of the headboard and the support.
Figure 1:
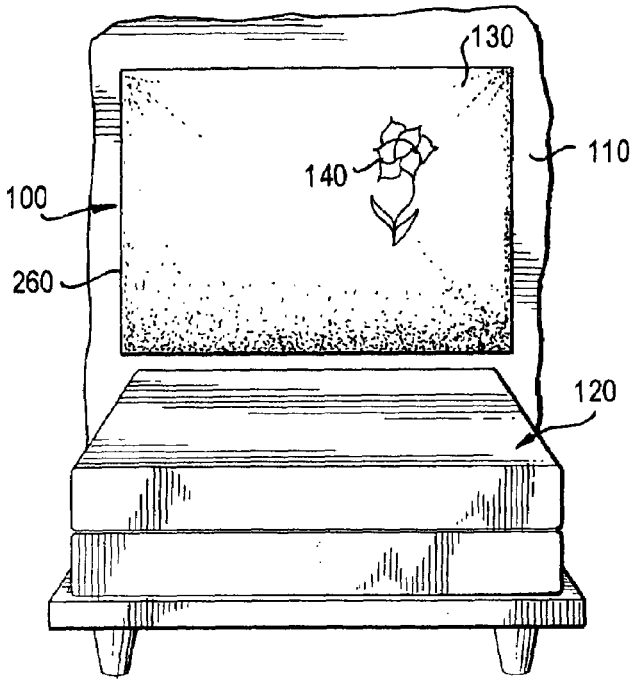
FIG. 1 is a front elevational view of the headboard according to the present invention, showing the headboard mounted to a support and disposed above a bed.

Referring to FIGS. 1–2, a headboard 100 in accordance with the present invention, is preferably mounted on a support 110, such as a wall, above a bed 120 but can be mounted above any piece of furniture, such as a chair, or simply mounted on the support 110 with no furniture underneath. The headboard 100 is separate from the bed frame (not shown) of the bed 120 and therefore can be purchased and moved separately, and does not require assembly with the bed frame in order to use the headboard 100. The headboard 100 is lightweight and is releasably mounted to the support 110, thereby allowing the headboard to be easily removed and moved to another location.

The headboard 100 is simple and inexpensive to make generally including a cover 130 that may display decorative indicia 140, such as decorative images, patterns, or text, and a inner cushioning member 210. The headboard 100 can by any shape including rectangular, square or circular. The cover 130 is preferably formed of any flexible material, such as fabric, leather or plastic. The cover 130 includes front and rear panels 220 and 230, top and bottom panels 240 and 250 and side panels 260 (FIG. 1) substantially enclosing the cushioning member 210. A zipper or hook and loop opening (not shown) can be provided in cover 130 to allowing the cushioning member 210 to be inserted into the cover 130. The indicia 140 is preferably provided on the front panel 220 but can be included on any of the panels 220, 230, 240, 250 and 260.

Figure 3:
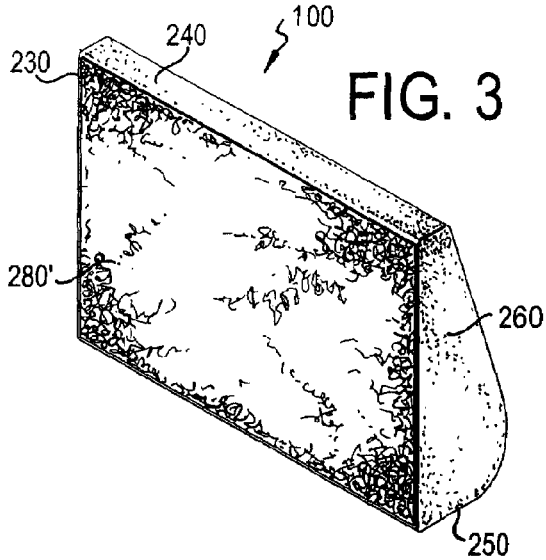
FIG. 3 is a rear perspective view of the headboard illustrated in FIG. 1, showing a hook and loop releasable attachment according to another embodiment of the invention.

The rear panel 230 of cover 130 is adapted to mount to the support 110. The rear panel 230 is preferably formed of a fastener type fabric. For example, the rear panel can be formed of a woven or knitted fabric that includes a plurality of loops, such as VELTEX® fabric. The fastener fabric with the plurality of loops can encompass the entire rear panel 230, as seen in FIG. 3, or the fabric with the plurality of loops can encompass only a portion of the rear panel 230, as seen in FIG. 2.

The cushioning member 210 is preferably formed of a light weight cushion material, such as foam or foam rubber.

A fastener 280 is disposed on the support 110, preferably by adhesive, for engaging the rear panel 230 of the headboard 100. The fastener 280 is compatible with the fabric of the rear panel 230. For example, the fastener 280 is preferable formed of a plurality of hooks, such as VELCRO®, that releasably engage the plurality of loops of the rear panel 230. The fastener 280 encompasses a portion of the rear panel, as seen in FIG. 2. A fastener 280' is the same as the fastener 280, except it encompasses substantially the entire area of the rear panel 120, as seen in FIG. 3.

Although the rear panel 230 of the headboard 100 is preferable mounted to the support 110 by a hook and loop attachment, any type of attachment can be used, such as adhesive or fasteners like screws.

Since the headboard 100 is lightweight, the headboard 100 can be easily mounted to the support 110 by engaging the rear panel 230 with the fastener 280. The height of the headboard 100 with respect to the bed 120 can be adjusted in two ways. First, the height and placement of the fastener 280 on the support 110 can be selected as desired and changed. Second, since the entire rear panel 230 includes the fastener fabric of the plurality of loops, the rear panel 230 can engage the fastener 280 at any height along the rear panel 230.

While a particular embodiment has been chosen to illustrate the invention, it will be understood by those skilled in the art that various changes and modification can be made therein without departing from the scope of the invention as defined in the appended claims.

What is claimed is:

1. A headboard, comprising:

a cushioning member;

a flexible cover substantially enclosing said cushioning member, said flexible cover including at least first and second opposite panels, said first panel being formed of a fabric having a plurality of loops, said plurality of loops encompassing substantially all of said first panel; and a support including a fastener disposed thereon, said fastener being formed of a plurality of hooks engaging said plurality of loops of said first panel, thereby releasably engaging said first panel with said support.

2. A headboard according to claim 1, wherein said second panel includes decorative indicia.

3. A headboard according to claim 1, wherein said fastener is fixed to said support by adhesive.

4. A headboard according to claim 1, wherein said cushioning member is formed of either one of foam and foam rubber.

5. A headboard according to claim 1, wherein said support is a wall.

6. A headboard according to claim 1, wherein said first and second panels are rear and front panels, respectively; and said cover includes top and bottom panels and opposite side panels.

7. A headboard, comprising:

a headboard member, including a cushioning member, and a flexible cover enclosing said cushioning member, said flexible cover including at least rear and front opposite panels, said rear panel having a plurality of loops, said plurality of loops encompassing substantially all of said rear panel, and said front panel including decorative indicia, said headboard member being entirely non-rigid; and a support including a fastener fixed thereto, said fastener being formed of a plurality of hooks engaging said plurality of loops of said rear panel, thereby releasably engaging said rear panel with said support.

8. A headboard according to claim 7, wherein said cushioning member is made of one of foam and foam rubber.

9. A headboard according to claim 8, wherein said flexible cover is made of fabric.

10. A headboard according to claim 9, wherein said flexible cover is removable from said cushioning member.

* * * * *